US010589310B2

(12) United States Patent
Maier et al.

(10) Patent No.: US 10,589,310 B2
(45) Date of Patent: Mar. 17, 2020

(54) DEVICE AND METHOD FOR COATING OBJECTS

(71) Applicants: KAHLA THÜRINGEN PORZELLAN GMBH, Kahla (DE); TOMABOND GMBH, Erlangen (DE)

(72) Inventors: Tobias Stephan Maier, Langenzenn (DE); Holger Raithel, Jena (DE)

(73) Assignees: Kahla Thüringen Porzellan GmbH, Kahla (DE); Tomabond GmbH, Erlangen (DE)

( * ) Notice: Subject to any disclaimer, the term of this patent is extended or adjusted under 35 U.S.C. 154(b) by 36 days.

(21) Appl. No.: 15/502,886

(22) PCT Filed: Aug. 12, 2015

(86) PCT No.: PCT/DE2015/100336
§ 371 (c)(1),
(2) Date: Feb. 9, 2017

(87) PCT Pub. No.: WO2016/023541
PCT Pub. Date: Feb. 18, 2016

(65) Prior Publication Data

US 2017/0232466 A1 Aug. 17, 2017

(30) Foreign Application Priority Data

Aug. 12, 2014 (DE) ..... 10 2014 111 446

(51) Int. Cl.
*B05D 1/00* (2006.01)
*B05D 1/02* (2006.01)
(Continued)

(52) U.S. Cl.
CPC ..... *B05C 13/02* (2013.01); *B05B 13/02* (2013.01); *B05D 1/02* (2013.01); *B05D 1/18* (2013.01)

(58) Field of Classification Search
None
See application file for complete search history.

(56) References Cited

U.S. PATENT DOCUMENTS 3,175,820 A 3/1965 Schiler
4,025,103 A * 5/1977 Eichstaedt ..... B60J 1/20 160/370.21

(Continued)

FOREIGN PATENT DOCUMENTS

DE 102004047705 4/2006

OTHER PUBLICATIONS

International Search Report issued by the European Patent Office in International Application PCT/DE2015/100336, (2016).

*Primary Examiner* — Alexander M Weddle
(74) *Attorney, Agent, or Firm* — Ursula B. Day

(57) ABSTRACT

The invention relates to a device for arranging objects in particular tableware, in a system for coating including a base element, an adapter element and a support element, each of which are designed in such a manner that they can be plugged together in a direction (z). In the plugged-together state, the adapter element is arranged between the base element and the support element with the object disposed in a predetermined position on the adapter element. The adapter element, the base element and the support element are locked relative to one another with the object in such a manner that only a relative movement in the direction (z) is possible amongst each other. The invention further relates to a method for the arrangement of objects, in particular tableware with the device, in a system for coating.

9 Claims, 1 Drawing Sheet

(51) Int. Cl.

| | |
|---|---|
| ***B05C 13/00*** | (2006.01) |
| ***B05C 13/02*** | (2006.01) |
| ***B05B 13/02*** | (2006.01) |
| ***B05D 1/18*** | (2006.01) |

(56) References Cited

U.S. PATENT DOCUMENTS

| | | | | |
|---|---|---|---|---|
| 4,169,908 | A | 10/1979 | Hatfield | |
| 4,222,577 | A * | 9/1980 | Giffin | B23B 31/16004 269/156 |
| 4,531,559 | A * | 7/1985 | Glasgo | B27F 1/12 144/144.1 |
| 2008/0064807 | A1 | 3/2008 | Weidinger et al. | |
| 2009/0301269 | A1 * | 12/2009 | Wedge | B25B 13/48 81/124.2 |
| 2012/0260429 | A1 * | 10/2012 | Rolfes | A61G 13/101 5/637 |

* cited by examiner

DEVICE AND METHOD FOR COATING OBJECTS

CROSS-REFERENCES TO RELATED APPLICATIONS

This application is the U.S. National Stage of International Application No. PCT/DE2015/100336, filed Aug. 12, 2015, which designated the United States and has been published as International Publication No. WO 2016/023541 and which claims the priority of German Patent Application, Serial No. 10 2014 111 446.9, filed Aug. 12, 2014, pursuant to 35 U.S.C. 119(a)-(d) the description of which is hereby incorporated by reference.

BACKGROUND OF THE INVENTION

The invention refers to a device for the arrangement of objects, in particular tableware from porcelain, glass or similar work materials having different tolerance ranges within a system for coating, The device includes a basic element, an adapter element and a support element.

The invention also refers to a process for arrangement of objects within the system for coating.

Objects known in the prior art, for example tableware from porcelain or glass, on the one hand exhibit large tolerance ranges during production and additionally are formed with either very smooth or very rough surfaces. Contact of smooth surfaces, with other, similarly smooth surfaces, such as can occur especially during transporting the objects, can result in the skidding of the object on the base. In addition, contact of rough surfaces with other surfaces easily leads to scratching of the surface of the base.

Large tolerance ranges that occur during production of the object also effect a deviation of a plane level surface and thus can lead to clatter or toppling of the object on a level ground. In particular, when placing objects such as tableware within a moving system like a ship, air plane or car, the effects of toppling, clatter and slipping can thus cause scratching of surfaces.

From the prior art the application of coatings is known only relative to identical work materials for example on plastic housings or stamped parts of metal. An industrial reproducible application of work materials having big tolerance ranges is not possible.

DE 10 2004 047 705 A1 discloses a coating on household objects, in particular tableware exhibiting a reduction in the level of noise that can occur during handling. The coating includes an elastomer or a thermoplastic elastomer and is applied to those sites on the tableware generally known for generating noise or prone to breakage. Alternatively the tableware is made of elastomers or thermoplastic elastomers.

After production of the tableware piece, the elastomer material is applied to the piece by coating such as spraying, dipping, spread coating, by supermolding, for example, by means of injection molding or press molding, by gluing, for example with an elastomeric part produced by any shaping process, or by connecting, for example, by means of a separate support for the elastomeric portion applied to the tableware. The connection between the tableware piece and elastomeric material is based either on a chemical adherence or a mechanical interlocking, as in undercuts or breakthroughs.

According to DE 10 2004 047 705 A1 , an injection mold is provided for the production of a tableware piece which is durably coated with elastomeric material. Following that, a heatable metal mold is constructed around the tableware piece, so that a hollow space is formed along especially wear-prone sites which can be filled with elastomeric material. The tableware piece is sealed against the injection mold. The tableware piece preheated to 80° C., is placed into the injection mold that is pre-heated to 150° C., the mold closed, and a self-adhesive, tear-resistant silicone mass injected through the runner. Thereafter, the injection mold is placed in a vertical press and vulcanized at 100 bar and 180° C. over a time period of 5 minutes. After removal, the coated tableware piece is tempered for 4 hours at 200° C. in a circulating oven.

The coating by means of injection molding results in connecting the areas of the tableware piece with a silicone bead which is very thick and is thus noticeable on the piece. In addition, the pressing step in the vertical press bears the danger of breaking and destroying the piece.

The devices and methods known in the prior art for coating objects or work pieces are also labor- and cost intensive and producing the coating requires high energy input.

SUMMARY OF THE INVENTION

Object of the present invention is to provide a device and a process for coating objects with a skid-proof and damping material or work material. The coated objects should however not be structurally altered by the process. The device used for the process should be adaptable through minimal means or adaptations for the coating of a variety of objects. Furthermore, the device should be easy to handle and to operate and require minimal energy consumption. The steps of the coating process should be such that a destruction of the object to be coated is virtually ruled out. The process of coating the objects should also consume little time and be cost-saving.

These objects are solved by the device and method according to the features as claimed in the independent claims. Additional features are embodied in the independent claims.

These objects are solved by a device according to the present invention for arranging object pieces, in particular tableware pieces, in a coating system. The device includes a base element, an adapter element and a support element.

According to the concept of the present invention, the base element, the adapter element and the support element can be mounted in a one-directional manner.

When the device is mounted together, the adapter element is located between the base element and the support element. The object between adapter element and support element is thereby arranged on the support element in a pre-determined position and fixed at the support element. The adapter element, the base element and the support element with the object arranged thereon, when mounted together, are fixed relative to each other, to realize a relative movement exclusively in a direction of mounting. Mounting of the device is advantageously done in a vertical direction from upward to downward.

According to an advantageous embodiment of the present invention, the base element is configured as a flat surface plate provided with guidance and fixing means, which means project vertically from the plate on a level plane. The level plane opposite that of the direction of the way the device is plugged together. The plane is on a level vertical relative to the direction of the device plugged together and amongst themselves vertically arranged and thus in preferably horizontal directions.

The guide means have a cylindrical shape, in particular, a circular cylindrical shape. The guide means are preferably arranged in a peripheral zone of the base element that is configured as a flat plate.

In a further development of the present invention, the adapter element is configured as a flat plate. The adapter element preferably has recesses for accommodating the locking means of the base element. In plugged together state of the device, the locking means engage the recesses. Thereby, the locking means engage in the recesses in such a way that the adapter element is locked with the base element. By "locking" it is understood that the adapter element is connected to the base element and that a relative movement can only be in the direction of plug-in.

According to a preferred embodiment of the present invention, the adapter element in a plugged together state of the device is provided with a casting compound at the side facing the support element. The casting compound shows an impression of a predetermined area of the object.

As a predetermined area for the impression, the bottom side of the object on which the object rests when utilized is preferred and which is to be coated. Thus, the object is preferably placed with the bottom side into the impression formed at the adapter side, so that the object cannot move in any horizontal direction.

According to a further development of the present invention, the support element is configured with guide elements which are firmly connected to the support element and provided for receiving the guide means of the base element.

The support element is advantageously configured as a level plate and is provided with through-openings arranged in a peripheral zone on the level surface in horizontal direction. In this manner, each through-opening and guide element is arranged in correspondence relative to each other, so that the through-opening and the guide element share a common center axis. The center axes extend in vertical direction.

In a further advantageous embodiment of the present invention, the support element has holding means by which the object can be fixed at the support element. The holding elements are preferable constructed as suction elements or vacuum suction pads. With the aid of generating vacuum through suctioning of air, the object to be held at the holding elements is sucked onto the holding elements and thus adhered to the support element.

A further solution the present invention provides for a method of arranging objects, in particular tableware, in a system for coating by means of a device having the aforedescribed features. The method includes the following steps.

- producing a cast from a portion of the object in the casting material, wherein the casting material if provided at an adapter element,
- placing the adapter element on the base element, wherein the adapter element is arranged with the casting material area facing away from the base element,
- placing the object onto the adapter element, wherein the object is placed with the area corresponding to the impression into the cast,
- placing a support element onto the object,
- attaching the object at the support element,
- removing the support element with the object from the base element and the adapter element,
- introducing the support element with the object into a system for coating,
- coating an area on the object.

According to an advantageous embodiment of the present invention, upon placing the adapter element onto the base element, the adapter element is being locked by the base element, so that the base element and the adapter element are only movable relative to each other in the vertical direction, By placing the object on the adapter element or into the cast with the area corresponding to the cast impression, the object will be reproducibly aligned relative to the adapter element and within the device.

According to a further development of the present invention, when placing the support element on the object, the support element is guided by means of guide elements connected at the support element via the guide means formed at the base element. Thereby, the support element is locked by the base element, so that the support element and the base element are movable relative to each other in only vertical direction. The support element is preferably moved so that it can be lowered from above in vertical direction onto the object.

According to a further preferred embodiment of the present invention, the support element is placed onto the object by means of holding means arranged on the support element and the object fixed via the holding means of the support element. The object is advantageously held through a vacuum generated between the holding elements and the object on the support element. The object is suctioned onto the support element by means of the holding means that are arranged fixed at the support element and remains in this fixed position connected with the support element until the vacuum is no longer generated and the vacuum levels off to ambient pressure.

The support element with the object arranged thereon, after removal of the base element and the adapter element, is rotated advantageously about 180°, so that when removing the object arranged under the support element in vertical direction, after rotation about 180° the object is now arranged above the support element.

According to a further development of the present invention, the support element with the object arranged thereon is precisely positioned within the system for coating.

According to another variant of the present invention, the coating material is applied to an area at the bottom side of the object. Following that, the support element and thus the object will be removed from the coating system. By halting the generation of a vacuum, the object is loosened from the support element and then removed.

By coating household objects, such as tableware, from metal or ceramic, for example crockery, porcelain or clay, glass or plastic that have production generated tolerance differences, stability of the coated objects is increased and the noise level upon handling reduced. Coating is to be understood as the application of elastomers such as silicones, hybrids and co-polymers, or the application of glues or sealants onto work pieces. The coating can vary in thickness and extent, that is, it likewise applies very finely and thinly. The object can be introduced into the coating system in reproducible manner.

Objects coated with elastomers exhibit a number of advantages of utility, such as an increased skid stability on normal surfaces. By coating these objects, damping of a certain noise level is realized, sensitive surfaces of precious furniture are saved and service in the hotel and gastronomical industry is made easier. The coating of such tableware with elastomers having low heat capacity, in particular silicone, aside from reducing sliding friction, also provides a heat insulating stand surface. Since silicone, as an elastomer is temperature resistant relative to high and low temperatures, is food safe as well as easy to clean and detergent safe, there are no limitations on its normal use. In particular, when using self-adhesive silicone, shelf life of the tableware is unlimited because the silicone does not detach.

The machine coating of the objects with the skid-proof, damping material is carried out without further alteration of the objects, for example through construction of a U-profile on the object. Thus, the method of coating is adaptable to a variety of differently shaped objects simply by cost effectively adapting the adapter element on which the work piece is mounted.

Summarizing, the tableware coated with the device and method of the present invention exhibits further advantageous properties such as: being microwave-proof, dishwasher safe, oven-proof, odor neutral, color-fast, ageing resistant as well as resistant against sun exposure and high humidity.

Further details, features and advantages of the present invention follow from the description below of examples of embodiments with reference to the accompanying drawings. It is shown in:

PREFERRED EMBODIMENTS

Figure 1:
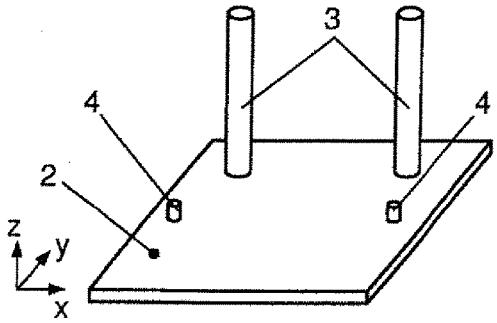
FIG. 1: a base element of the device with guide means and locking means.

FIG. 1-5 show the device 1 for coating an object 17 with each of the components base element 2, adapter element 5, cast 9 and support element 10.

FIG. 1 shows the base element 2 of the device 1 for arranging objects 17 for a coating system showing guide means 3 and locking means 4.

The base element 2 configured as a level plate, in the plane direction x, y has a rectangular surface and in depth direction z a thickness. The guide means 3 are arranged in a peripheral zone of the rectangular base element 2 with directions x, y on one level, that is, in the area of a first lateral edge of the surface. The cylindrical, especially circular cylindrical guide elements 3 project in direction z of the base element and are thus oriented vertical to the base element 2.

The locking means 4, similar to the guide means 3 are configured in direction z projecting from base element 2. The locking means 4 are arranged in the areas of opposite side edges.

Figure 2A:
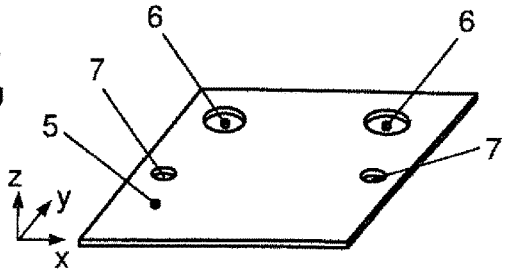
FIG. 2*a*: an adapter element of the device with through openings for the guide means and recesses for the locking means.

FIG. 2*a* shows the adapter element 5 of device 1 for the arrangement of objects 17 for a system for coating the objects 17 having through openings 6 for the guide means 3 and recesses 7 for the locking means 4 of base element 2.

The adapter element 5 in the directions x, y on the same level configured as a plate of a rectangular surface and in the depth direction z with a thickness. The through openings 6 are arranged in a peripheral zone of the rectangular surface of adapter element 5 extending in x, y direction, that is, in the area of a first lateral edge of the surface.

The through openings 6 are configured as circular through openings or through bores. The diameter of through openings 6 is thus greater than the outer diameter of guide means 3 of base element 2. This ensures that the guide means 3 fit easily through the through openings. In assembled state of the adapter element 5 and the base element 2, a gap remains between the guide means 3 and the through openings 6.

According to an alternative embodiment, at the marginal area of the in x, y direction extending surface, on which the through openings are located according to the first embodiment, the adapter element 5 is chamfered. In that case, the adapter element 5 exhibits a six-sided surface where at the site of the through openings according to embodiment according to FIG. 2*a*, the corner areas are cut. The cut areas can have different shapes in order to ensure proper recesses for the guide means 3 of base element 2 when assembling with the adapter element.

Recesses 7 can be also through openings. The recesses 7 are always formed and arranged so that the locking means 4 of base element 2, in plugged in state of device 1, correspond, in particular, in plugged in state of base element 2 and adapter element 5. The locking means 4 engage in recesses 7, so that the adapter element 5 is locked with the base element 2.

Figure 2B:
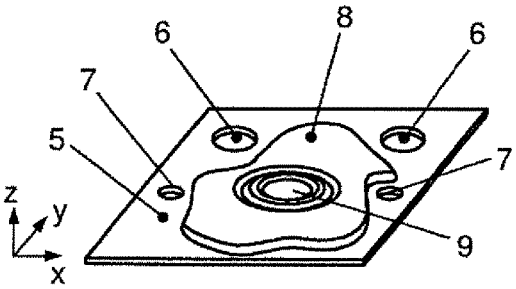
FIG. 2*b*: an adapter element with deposited casting material.

FIG. 2*b* shows adapter element with a casting material 8 applied to adapter element 5. Casting material 8 is applied to the adapter element 5 with a thickness of about 5 mm.

The casting material 8 is applied in such a way that the through openings 6 as well as the recesses 7 are not covered.

Casting material 8 which preferably is a synthetic polymer, in particular, silicone shows an impression 9 of the object 17 to be coated. Impression 9 is created from the bottom side or the foot of object 17, which in the following process steps of the coating is then at least partially coated.

Figure 3:
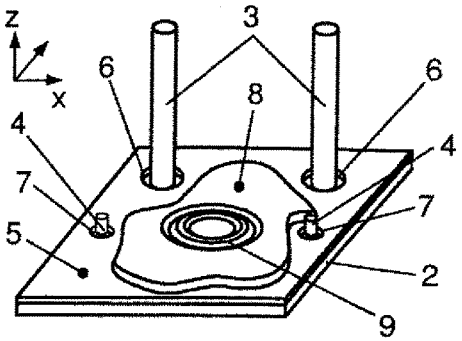
FIG. 3: a base element with adapter element and casting material.

FIG. 3 shows the base element 2 and the adapter element 5 with the casting material 8 in assembled state.

Upon assembly of the adapter element 5 and base element 2 the guide means 3 of base element 2 are fed through the through openings 6 of adapter element 5.

In the shown configuration of the recesses 7 as through openings, the locking means 4 project, starting from the base element 2, through the recesses 7 of adapter element 5. Due to the configuration of at least two locking means 4 and corresponding recesses 7, in plugged in state, the adapter element 5 is locked with the base element 2 in such a way that no relative movement between the base element 2 and the adapter element 5 is possible, except a movement in the direction z.

The base element 2 and the adapter element 5 form a compact coherent unit. The adapter element 5 is fastened on the base element.

After connecting the base element 2 with the adapter element 5, the object 17 to be coated is placed with its bottom side into the prepared impression 9 which was generated from the bottom side of object 17.

Thus, the object 17 is oriented relative to the adapter element 5. Since the adapter element 5 in turn is firmly fixed with the base element 2, the object 17 is also aligned in a reproducible manner. Each placement of identically shaped objects that follow, results in the same orientation of object 17 relative to base element 2.

Figure 4:
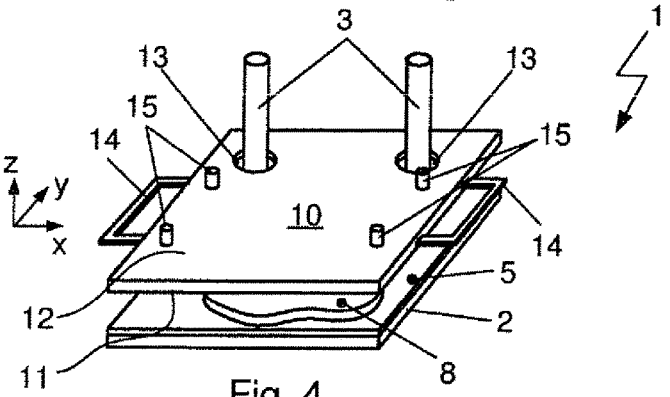
FIG. 4: a device in assembled condition with the object to be coated thereon.

FIG. 4 shows the device 1 for arranging objects 17 for a system of coating in plugged in state with an object 17 to be coated positioned between but not visible at a conclusion of a step in the coating process.

As compared to the fixed base element 2 and the adapter element 5 with casting material 8 as well as the formed impression 9 of object 17 according to FIG. 3, the support element 10 was plugged on top.

The support element 10 configured as a plate shows at the plane of the x, y directions, a rectangular surface, in the depth direction z, a thickness and includes a bottom side 11 and a top side 12. The support element 10 is oriented with its bottom side 11 in direction of the adapter element 5 with the cast impression 9 and the object 17 placed therein. Similar to the adapter element 5, the support element 10 includes through openings 13 for the guide means 3 of base element 2. These in turn are arranged in a peripheral zone of the rectangular surface at the plane of the x, y directions of the support element 10, that is, in the area of the first lateral edge of the surface. In the assembled state of device 1, the guide means 3 of base element 2, the through openings 6 of adapter element 5 and the through openings 13 of the support element 10 correspond with each other.

The support element 10, by means of grip elements 14 is placed over the guide means 3 and lowered opposite to direction z onto the object 17 to be coated.

The top side 12 is configured with fixing means 15 which project in direction z from the support element 10 and are oriented essentially vertical to the top side 12 of support element 10. The fixing means 15 serve the precise positioning of support element 10 in a system for coating with which the coating material is deposited on the object 17 to conclude the process.

Figure 5A:
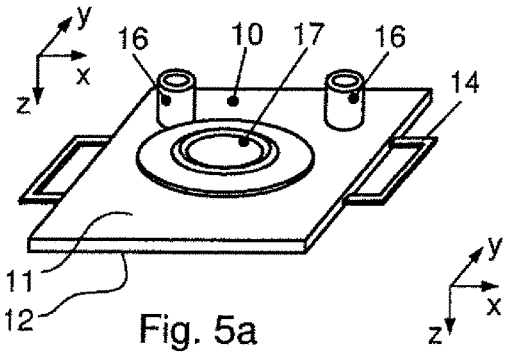
FIG. 5*a*: a support element of the device with an object received thereon, as well as, FIG. 5*b*: a support element of the device without the object to be coated.
Figure 5B:
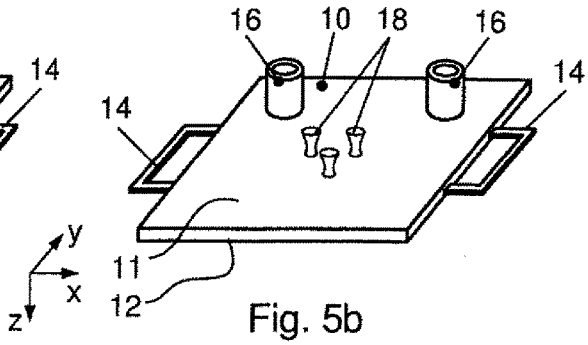

FIGS. 5*a* and 5*b* show the support element 10 of device 1 each in a top view of bottom side 11. In FIG. 5*a* the support element 10 is shown with the object 17 received and in FIG. 5*b* the support element 10 is shown without the object 17 to be coated.

Upon mounting the support element 10 on the guide means 3 and passing the guide means 3 through the through openings 13, the guide means 3 are guided by guide elements 16 configured as guide bushings that are firmly attached at the bottom side 11 of the support element 10. The through opening 13 and corresponding guide element 16 are arranged at a common center axis.

The guide elements 16 are preferably configured as flanged bushings. Upon a relative movement of the base element 2 and the support element 10, the guide means 3 glide through the guide elements 16 and fix the support element 10 in connection with the guide means 3 at base element 2, so that between the base element 2 and the support element 10 a relative movement is possible only in the z direction.

Since the adapter element 5 in mounted state of device 1 is locked in similar manner with the base element 2, no movement of support element 10 relative to the adapter element 5 is possible. The base element 2, the adapter element 5 and the support element 10 thus form a compact coherent unit. Also, since the object to be coated is fixed within the casting material 8 with the adapter element 5, the position of the support element 10 with respect to the object 17 is predetermined and reproducible. The object 17 is oriented relative to the support element 10. Each following placement of shape-identical objects 17, results in the same alignment of the object 17 relative to the support element 10.

At its bottom side, the support element 10 is configured with holding elements 18, which are arranged in such a way that at the final lowering the support element 10 during assembly of device 1, the holding elements rise to the object 17.

The holding means 18 are configured as negative pressure suction elements for generating a negative pressure and are operated by a foot switch, not shown here. With these suction elements of the holding means 18, the object 17 is suctioned to the support element 10 and connected therewith. Only if the vacuum system is cut off, can object 17 be removed from the support element 10.

After object 17 to be coated is attached via the holding elements 18 to the support element 10, the support element 10 with object 17 is lifted in direction z and removed from the base element 2 through the guide means 3.

FIG. 5*a* shows the state of the support element 10 with the attached object 17, after the support element 10 was rotated by 180° around an axis extending in direction x or y.

In the position as shown in FIG. 5*a*, the support element 10 with object 17, whose bottom side is oriented upwards due to the 180° rotation is then introduced into the coating system. The fixing means 15 that are now downwardly oriented but not shown in FIG. 5*a*, the support element 10 and thus the object 17 are precisely positioned within the coating system. Subsequently, the coating material is applied to the bottom side of the object 17. The system then coats a pre-programmed form for coating and applies at a pressure of about 8 bar, an elastomeric material for depositing, for example, a silicone of low to highly viscous consistency onto the predetermined areas at the bottom side of object 17. Low viscosity silicone is understood to be a self leveling silicone and high viscosity silicone is understood to be a stable silicone. Coating objects 17 made of porcelain is applied to an unglazed bottom.

Alternatively to the fixing means 15, the device 1 in connection with the system for coating can be operated also with other means for attachment or immobilization and thus represent a reproducible arrangement of the support element 10 within the system for coating. Through this reproducible arrangement of object 17 on the support element 10 with the aid of device 1 and the support element 10 in the system, objects 17 of identical shape, form and of identical dimensions can be coated in the same manner.

After removal of the support element 10 with the object 17 attached thereon, from the coating system, the negative pressure is released and the object 17 can be taken from the support element 10. The support element 10 is then ready, as shown in FIG. 5*b* for receiving the next object 17 to be coated.

The objects 17, for example articles from porcelain or glass can be precisely positioned by device 1 within the coating system, in order to apply the coating material, which for example is applied by a nozzle to object 17 to the correct sites at the bottom side of the object 17 in reproducible manner. The coating material dries in ambient air and hardens.

In order to be able to coat differently shaped objects 17, in each case, the adapter element 5 with impression 9 within the cast 8 is exchanged. Thus a speedy conversion of device 1 for objects 17 of different dimensions is realized. Each differently shaped object 17 is assigned a specific adapter element 5 with the special impression. Thus, it is possible to coat entire assortments of objects 17 in cost efficient manner.

Due to the very precise application of the coating material, the minimally necessary amount of coating material is utilized, and without the use of surplus coating material. The precise positioning of the objects within the system also results in zero breakage of objects 17. Thus, the cost of coating is reduced under minimal use of time and materials.

What is claimed is:

1. A device for arranging an object of tableware in a system for coating, the device comprising, a base plate provided with guide means in the form of projections extending from the base plate, an adapter plate provided with corresponding openings to engage the said projections, and a support provided with guide elements in the form of bushings to engage with projections of the base plate, wherein the support is mounted on the adapter plate in a one-directional mounting axis to hold the tableware object between the adapter plate and the support in a predetermined position, and fixed at the support, wherein the base plate, the adapter plate, and the support are in fixed position relative to each other to realize a relative movement only in a direction of the mounting axis, wherein the relative fixed position of the base plate, the adapter plate ,, and the support is realized by the projections of the base plate being engaged in corresponding openings in the adapter plate and being engaged with the bushings of the support.

2. The device according to claim 1, wherein the base plate is configured as a level plate from which the guide means extend as cylindrical projections and is further provided with locking means, said cylindrical projection and locking means each extend from the level plate in direction of the mounting axis.

3. The device according to claim 1, wherein the adapter plate in the assembled state of the device, at a side facing the support is provided with a cast from casting material, wherein the cast has an impression of an area on the object.

4. The device according to claim 1, wherein the support includes holding means which are configured for fixing the object at the support element.

5. A method for arranging objects, in a system for coating with a device according to claim 1 comprising the following steps:

generating an impression of an area on the object in a casting material, that is provided on the adapter plate to obtain a cast, placing the adapter plate on the base plate with the cast facing away from the base plate, placing the object on the adapter plate with the area of the object corresponding to the impression in the cast, placing the support on the object, fixing the object on the support , removing the support with the object from the base plate and adapter plate, introducing the support with the object into a system for coating, coating the area of the object.

6. The method according to claim 5, wherein the adapter plate is locked with the base plate upon placement onto the base plate.

7. The method according to claim 5, wherein the support , upon placement on the object, is guided by the bushings on the support via the vertical projections that are formed at the base plate, wherein the support is locked with the base plate.

8. The method according to claim 5, wherein the support is placed on the object with the holding means arranged at the support and the object fastened to the support via the holding means.

9. The method according to claim 5, wherein the object is held at the support by generation of a negative pressure between the holding means and the object.

* * * * *